United States Patent [19]

Sokoler et al.

[11] 4,441,291

[45] Apr. 10, 1984

[54] PANEL, IN PARTICULAR FOR SELF-SUPPORTING ROOF STRUCTURES AND SELF-SUPPORTING ROOF STRUCTURES ASSEMBLED OF SUCH PANELS

[75] Inventors: Henryk Sokoler, Roskilde, Denmark; Poul H. Evers, Pura Tessin, Switzerland

[73] Assignee: Everlite A/A, Skaevinge, Denmark

[21] Appl. No.: 300,510

[22] Filed: Sep. 9, 1981

[30] Foreign Application Priority Data

Jul. 20, 1981 [DK] Denmark ..... 3236/81

[51] Int. Cl.[3] ..... E04C 1/00

[52] U.S. Cl. ..... 52/309.1; 52/306; 52/588; 52/200; 126/445

[58] Field of Search ..... 52/309.1, 200, 306, 52/586, 588, 630; 126/445, 441; 428/188

[56] References Cited

U.S. PATENT DOCUMENTS

| | | | |
|---|---|---|---|
| 3,886,705 | 6/1975 | Cornland | 52/586 |
| 4,089,324 | 5/1978 | Tjaden | 126/445 |
| 4,212,291 | 7/1980 | Erb | 126/445 |

FOREIGN PATENT DOCUMENTS

| | | | |
|---|---|---|---|
| 897755 | of 0000 | Fed. Rep. of Germany . | |
| 2125537 | 4/1972 | Fed. Rep. of Germany | 52/586 |
| 1485237 | 7/1969 | France | 52/309.1 |
| 1584387 | of 0000 | France . | |
| 2317434 | of 0000 | France . | |
| 2339034 | of 0000 | France . | |
| 2385299 | 3/1977 | France | 52/306 |
| 2423596 | of 0000 | France . | |
| 461748 | of 0000 | Switzerland . | |
| 901935 | 7/1962 | United Kingdom | 52/309.1 |
| 1244155 | 8/1971 | United Kingdom | 52/586 |
| 1272729 | 5/1972 | United Kingdom | 52/586 |
| 1511189 | 5/1978 | United Kingdom | 52/309.1 |

*Primary Examiner*—Henry E. Raduazo

*Attorney, Agent, or Firm*—Stevens, Davis, Miller & Mosher

[57] ABSTRACT

A hollow panel of extruded plastics for walls and roof structures and having at least two main ducts separated by a secondary duct divided into three or more subducts, one of which is dimensioned so as to accommodate an anchor bar intended for absorbing upwardly directed wind pressure. Each of the main ducts is divided into two channels by a thinner intermediate wall extending through the secondary duct or ducts.

A self-supporting arcuate roof comprising such panels provided with coupling members forming together locking ducts wherein locking wedges or reinforcing bands of metal are inserted.

The subducts of the panels are designed to resist pressure and torsional forces without separate reinforcing elements.

12 Claims, 4 Drawing Figures

Figure 1:
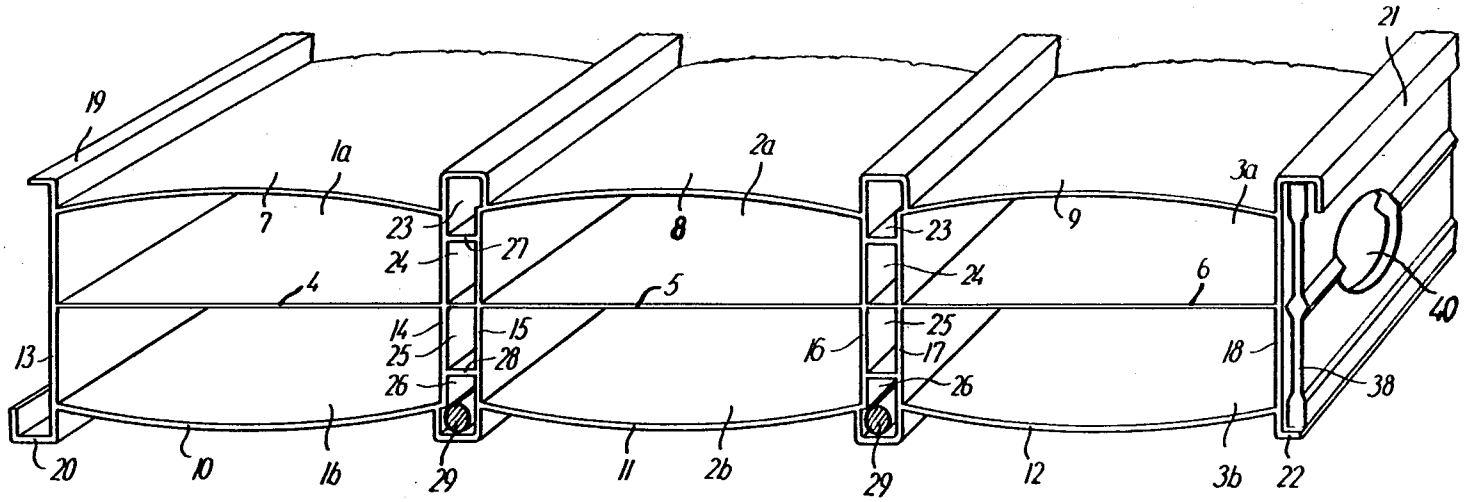

PANEL, IN PARTICULAR FOR SELF-SUPPORTING ROOF STRUCTURES AND SELF-SUPPORTING ROOF STRUCTURES ASSEMBLED OF SUCH PANELS

The invention relates to a panel, in particular for self-supporting roof structures and of the type consisting of extruded, preferably translucent, profile elements of plastics material, expecially polycarbonate, said elements having at least two longitudinal ducts and coupling members making it possible to assemble the profile elements side by side to form a continuous surface, in particular a roof surface, requiring only to be supported along two opposite ends.

U.S. Pat. No. 3,886,705 discloses such a hollow panel having a plurality of ducts mutually bounded by partitions formed as I-beams and stiffened on both sides by separate stiffening members. The side walls have concave outer surfaces.

British Pat. No. 1,511,189 discloses a single profile element, the duct of which is divided into two parts by a partition extending substantially parallel to the convex outer surfaces. The profile elements can be assembled to form panels.

Such known panels are used in building structures, e.g. walls and roofs. The former structure offers the advantage of requiring less assembling operations for the erection of a surface of a given dimension, but drawbacks in connection with manufacture and load carrying capacity have prevented it from gaining ground in practice.

The second known structure is used to a large extent but requires a greater number of assembling operations for the manufacture of, e.g. a roof of the same given dimensions as above. The fact that this known panel element, owing to the presence of the intermediate wall, possesses extremely good properties with regard to heat insulation has resulted in the acceptance of the drawback that it is only available as single profile element and not as a panel by itself having a plurality of adjacent ducts.

It is an object of the present invention to provide a panel having none of the drawbacks of the known structures.

According to the invention this is achieved by providing each of the profile elements with at least two main ducts lying side by side, separated by an intermediate secondary duct, each of the main ducts being divided into two channels by means of a substantially plane intermediate wall situated approximately halfway between the external convex outer surfaces of the profile element.

The two partition walls bounding the secondary ducts ensure a great stability of the panel during the manufacture as well as in use. The mainly rectangular structure which has these partitions as constituent parts does not, like the known structure tend to upset and collapse unless special stiffening members are used to absorb pressure at right angles to the outer wall. The panel can therefore be used as a roof surface in geographical areas where there is a risk of considerable snow loads. The good heat-insulating properties of the panel are of special advantage in such areas.

The outer shape and the appearance of the secondary duct correspond to the outer shape of that duct and the joining duct which is formed when two panels are assembled side by side. This constitutes an advantage from an architectural point of view.

In a suitable embodiment of the panel according to the invention, the secondary duct is divided into at least three subducts by walls mainly parallel to, and having substantially the same thickness as the outer walls. These intermediate walls are suitably disposed in the vicinity of the plane of the outer walls, so as to form a couple of smaller, mainly rectangular subducts along the outer and the inner surfaces, separated by a larger, oblong, rectangular duct. This design prevents the secondary duct from acting as a heat sink, and provides an additional strengthening of the structure, the box-shaped profiles making the panel still more resistant against a collapse of the wall of the secondary ducts due to a load on, for instance, the outer side of a roof surface.

When the panel is to be used in a self-supporting roof structure, its design shows a curvature in the longitudinal direction, and it is supported only at its two extremities. In order to reinforce such self-supporting structures against pressure loads, metal bands may, in a manner known per se, be inserted as reinforcing members in the joining ducts instead of the usual locking wedges. In the new panel structure, corresponding reinforcements can be dispensed with in the secondary ducts, as their stiffness is by itself sufficient.

It has, however, turned out that self-supporting roof structures can be subjected to uplift forces on account of wind loads on the under side, and therefore it is preferred, for reasons of security, to abstain from using the panels in some free-standing roof constructions. With a view to avoiding this limitation in the use of the panel, at least one of the subducts is, according to the invention, dimensioned so as to allow the insertion of an anchor bar which is able to absorb the forces originating from upwardly directed wind pressure. The anchor bars are, at their extremities, arranged to be secured to supports, preferably so that said bars can be under tensile stress.

In a further embodiment according to the invention, the secondary duct is divided into four subducts by means of three partition walls, one of which lies on the same level as the intermediate wall of the main ducts, while the two others are spaced, respectively, from the nearest end wall of the secondary duct so as to form a subduct of cross-sectional dimensions sufficient to allow the insertion of a anchor bar in the duct. The provision of a third intermediate wall on the same level as the intermediate wall of the main ducts does not, in this construction, result in a substantial decrease in thermal loss due to a difference in temperature between the outer surface and inner surface of the panel, because two other intermediate walls are already provided. The presence of the central intermediate wall which, even in the case of cross loads, is only subjected to tensile stress and, therefore, can be thinner than the other walls, results in a substantial reinforcement of the structure, owing to an important reduction in the deformation of the side wall of the secondary duct due to pressure loads on the outer side of the panel.

It appears logical to give each of the four subducts of the secondary duct a rectangular cross-section. It may, however, prove advantageous to give only the two outer subducts a substantially rectangular cross-section, while the two intermediate subducts are four-sided in cross-section, have one common side on the same level as the intermediate wall of the main duct and have each one side parallel thereto and in common with the two outer subducts, the two other opposite sides forming an acute angle with each other. Such construction achieves a greater resistance to torsions and skew loads.

The invention relates furthermore to a self-supporting roof structure composed of panels each consisting of at least two, preferably three hollow profile elements of thermoplastics material extruded in one piece, said panels being provided along their sides with assembling members in engagement with each other to form a locking duct and interlocked by means of locking members inserted in the locking ducts. Each of the hollow profile elements of the panels composing this structure has convex outer surfaces which, together with two mainly parallel lateral surfaces, form a main duct of substantially rectangular cross-section, which main duct is, by means of an intermediate wall extending in the longitudinal direction, divided into two parallel ducts, the said lateral surfaces together with corresponding lateral surfaces of an adjacent profile forming secondary ducts which, by means of at least two intermediate walls extending mainly parallel to the outer surfaces, are divided into subducts of substantially rectangular cross-section. This roof structure presents a number of advantages which make it suitable for various purposes. Said structure is light, solid and heat-insulating, and it is labour-saving as far as transport to the building site as well as panel assembling are concerned. One achieves a simplification already when using panels having two main ducts and an intermediate secondary duct, but the assembling operations are, of course, reduced in proportion to the increase in the number of main ducts composing the panel. Although it is possible to use panels having more main ducts, a panel having three is, however, preferred when the dimensions used are the usual ones, where each main duct is about 8×5 cm, because such a panel is easier to handle.

Figure 2:
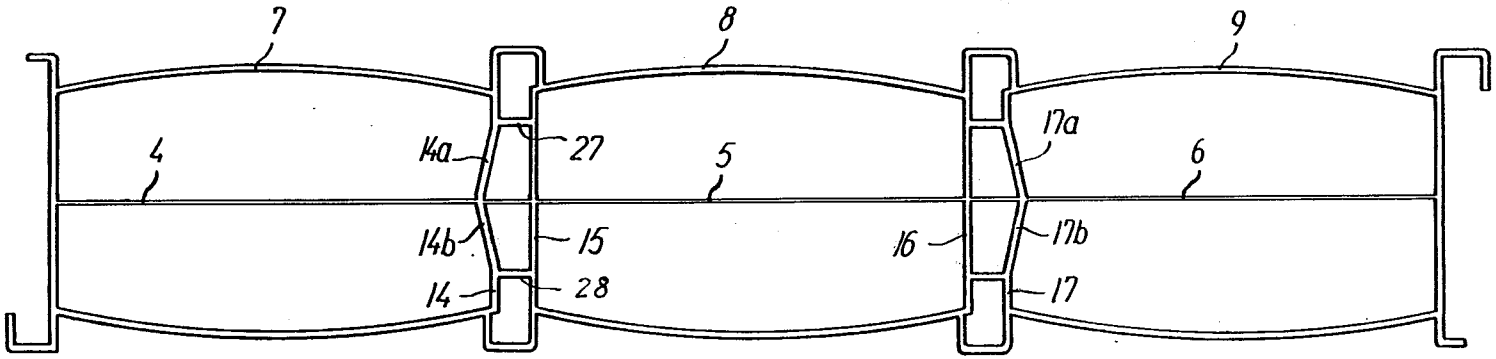
Figure 3:
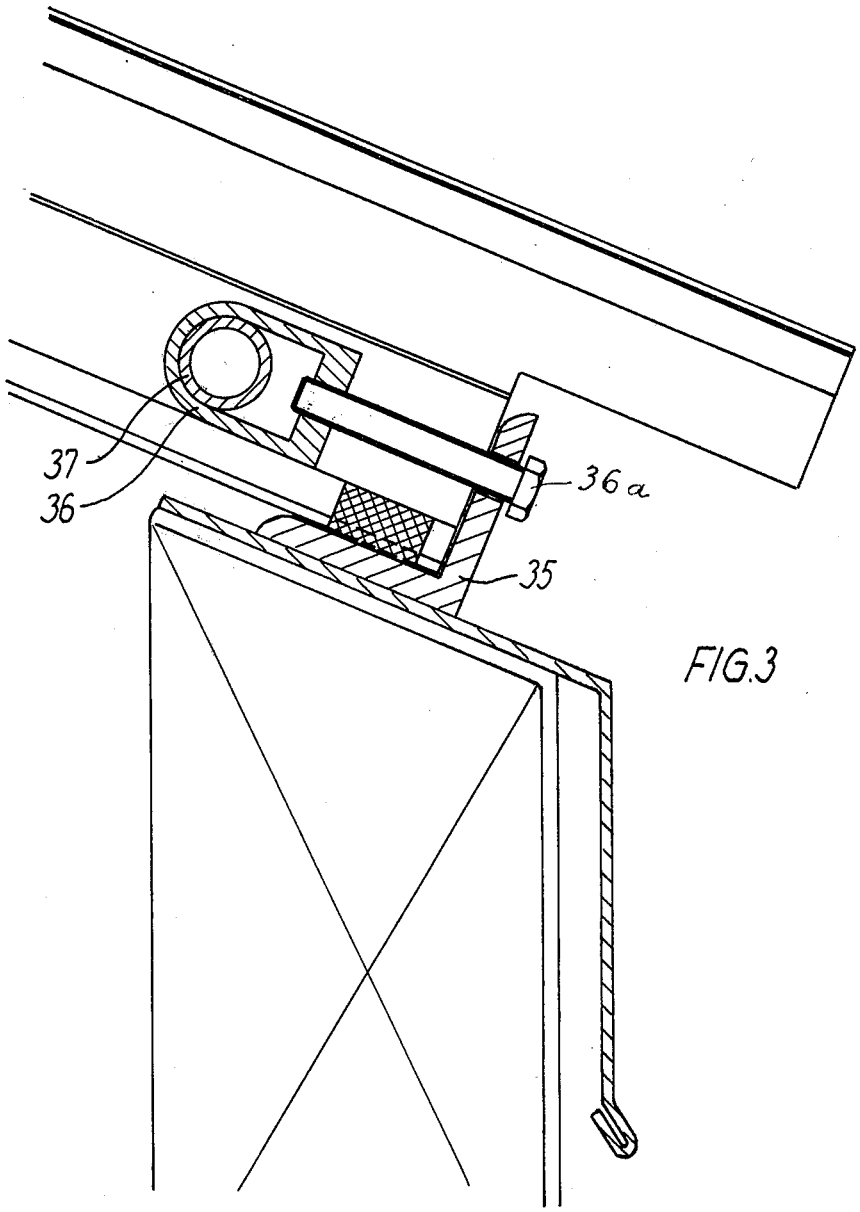
Figure 4:
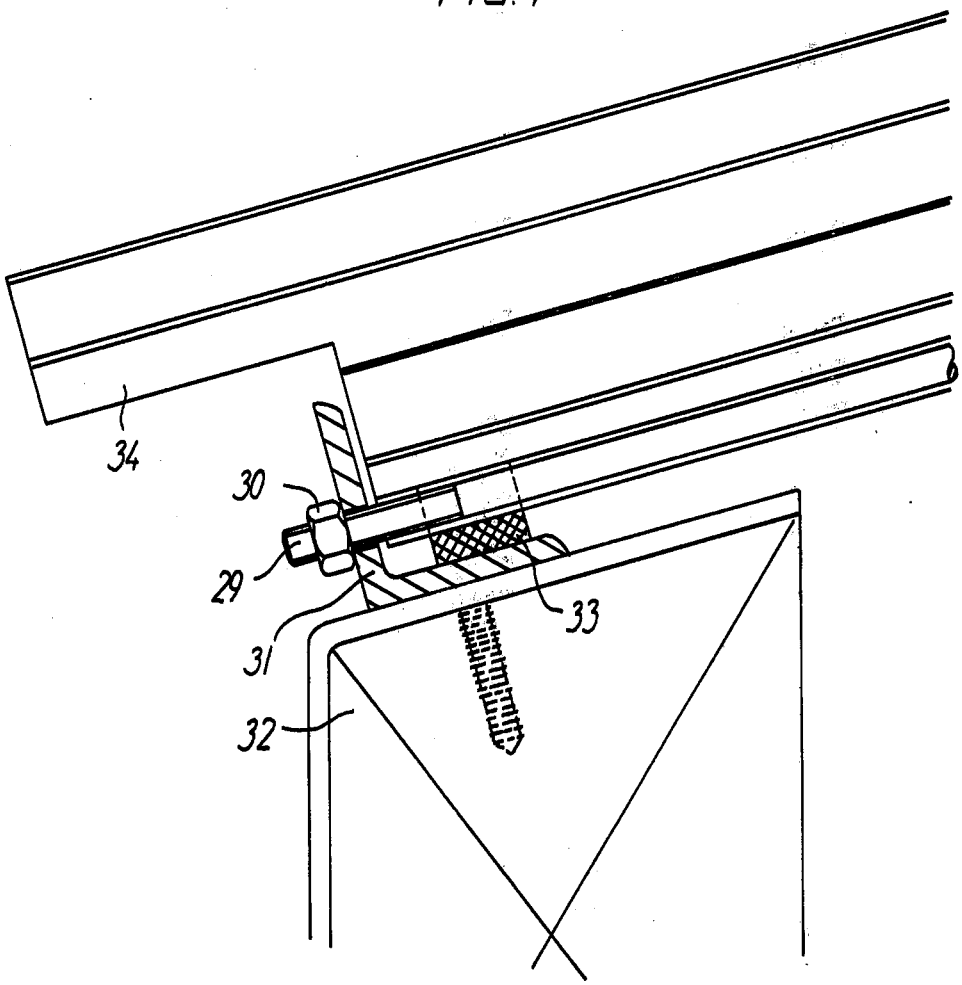

In the following, the invention will be explained in greater detail with reference to the accompanying schematic drawing in which FIG. 1 shows a prespective view of part of an embodiment of a panel having three main ducts, FIG. 2 shows an altered embodiment of a panel according to the invention as seen from the end, FIG. 3 is a side view partly in section, of part of a panel according to the invention, with mounting members for securing the panel to a support, and FIG. 4 is a side view, partly in section, of part of a panel according to the invention, with anchor bars for absorbing wind loads on the under side of a roof surface.

The panel of the invention as shown in FIG. 1 is manufactured in one piece by extrusion and is made of plastics material, preferably polycarbonate. The thermoplastics material may be translucent. The panel may be used for building walls, but it is especially dimensioned for roof surfaces intended to be self-supporting, so that the panel only requires support at its extremities.

The panel is hollow and may be provided with two or more main ducts generally numbered 1, 2 and 3 but designated in FIG. 1 as *1a, 1b; 2a, 2b; 3a, 3b,* since each of the main ducts is divided into two channels by means of an intermediate wall 4, 5 and 6, respectively. Each of the main ducts 1, 2 and 3 is bounded by outer walls 7, 8 and 9, respectively, inner walls 10, 11 and 12, respectively, and lateral walls 13, 14; 15, 16; and 17, 18, respectively. The side wall 13 is provided at the top and the bottom with corresponding coupling means 19 and 20 of conventional type. The lateral wall 18 is provided with corresponding coupling parts 21 and 22. When assembling two adjacent panels, a part 21 of one of the panels will engage with a corresponding part 19 on the other panel, while a part 20 will engage with a corresponding part 22, so as to form an assembly which can be designated as an assembling duct and is adapted to accommodate wedges or bands 38, the panels being thereby locked steadily together to form a surface, e.g. a roof surface.

The lateral walls 14 and 15 form, like the lateral walls 16 and 17, the walls of a secondary duct providing a separation between the main ducts 1, 2 and 2, 3, respectively. Each of the secondary ducts is divided into four subducts of mainly rectangular cross-section 23, 24, 25 and 26, respectively.

The subducts 23 and 26 are externally bound by walls having the same shape as the coupling members 20 and 21. This design has mainly been chosen for architectural reasons and may be departed from, if this should prove suitable. The subducts 23 and 26 are, furthermore, bound by intermediate walls 27 and 28, respectively. As it will appear from the figure, these subducts have a mainly rectangular cross-section. However, an enlargement is provided which is sufficient to allow the insertion of an anchor bar 29 so dimensioned as to be able to neutralize the forces arising from the wind load on the under side of a self-supporting roof surface. The number of required anchor bars depends upon the wind load in each individual case. FIG. 4 shows how the anchor bar 29 by means of a nut 30 abutting against an angle profile 31 can be set under tensile stress. The angle profile 31 is secured to a support 32, and between the angle profile and the panels forming the roof surface a profiled sealing strip 33 is inserted. The external, lower part of the panel has been cut away so as to provide a projecting part 34 preventing rain water from reaching the angle profile.

The panel is shown as a plane in FIG. 4 but when intended for use in a self-supporting structure, it will be arcuate, so that it only requires support at each extremity, for instance as shown in FIG. 4.

The anchoring proper of the roof surface composed of the panels appears in FIG. 3 which shows the right end of a roof surface, the left end of which is shown in FIG. 4. In FIG. 3, 35 is an angle profile corresponding to the angle profile 31 of FIG. 4. An anchor member 36 having substantially the shape of a closed U is connected with the angle profile by means of a screw 36*a* fastened in a threaded hole in the anchor member 36. Along the angle profile 35 provision is made for a suitable number of anchor members 36, and through all of them is carried a tube 37, preferably of aluminium, passing through holes in the lateral walls of the panel. In cases where, as shown in FIG. 1, provision is made of a combined strengthening and locking member 38, said member is also provided with holes 40 in both of its ends for the tube 37. The under side of the panel rests on the angle leg of the angle profile secured to the support. As the roof surface is self-supporting and is only supported at each extremity, no special measures are necessary in order to counteract extensions and contractions due to temperature variations.

In the embodiment of FIG. 1, the lateral walls of the secondary ducts are parallel. It may, however, be advantageous to choose other designs, one of which is shown in FIG. 2. In this latter embodiment, two parts 14*a* and 14*b* of the lateral wall 14 form a small angle with the other parts of the lateral wall 14. The lateral wall 17 is provided with similar parts 17*a* and 17*b*. The lateral walls 15 and 16 may be designed in the same or a similar manner.

A structure of this type is adapted to absorb torsional forces resulting from irregular loads which may occur if snow accumulates at different places on the roof surface.

The box profiles constituting the secondary ducts give a great compressive strength and the intermediate wall of the secondary duct which is in alignment with the intermediate walls 4, 5 and 6 of the main ducts prevents an outward bending of the vertical lateral walls of the secondary ducts. The distance between the secondary ducts is chosen so that it will be natural, when walking on the roof, to step only on the projecting, less yielding walls of the secondary ducts. The wall thickness will normally be uniform throughout the profile and be chosen in view of the nature of the material and of the desired strength of the product. The continuous intermediate wall 4, 5 and 6 extending through the main ducts and the secondary ducts may, however, be substantially thinner, e.g. less than half the wall thickness of the rest of the panel, which saves a significant amount of material. In the embodiments shown, the continuous intermediate wall is placed in the middle of the panel, which results in no difference in the properties of the panel, whether it is subjected to pressure loads on one or the other of the two outer walls. In a plane condition, it is therefore of no consequence which surface faces up.

In a suitable construction of the panel, one lateral wall of each secondary duct is plane and vertical, when the panel is mounted as part of a roof surface, so that these lateral walls in particular absorb the vertical pressure forces. The parallel nonplanar lateral walls are particularly useful when skew loads and torsional forces occur.

As it will appear from FIG. 2, the intermediate wall 27 is nearer the horizontal central plane of a line passing through the intermediate walls 4, 5 and 6 than to the outer walls 7 and 8. This results in the oblique lateral walls 14*a* of the secondary duct absorbing a greater part of the tension occurring in the intermediate wall 4, when the outer wall 7 is subjected to a downwardly directed pressure.

Owing to the structure of the secondary ducts, it is not necessary to insert reinforcing bars in these ducts, which is both material- and labour-saving. Building structures made of the panels according to the invention are therefore cheaper and better than the known structures, whether these are composed of profile elements having only one main duct or panels having three main ducts.

For the sake of clarity, FIG. 1 shows only a hole 40 in the locking member 38 but not corresponding openings made in the lateral walls 13, 14, 15, 16, 17 and 18 of the panel. Further, the intermediate walls are shown before they have been cut to give space for the continuous tubular anchoring member 36, shown in FIG. 3, and a closing member (not shown) inserted at the extremity of each main duct with a view to preventing free passage of air and penetration of impurities.

FIG. 3 illustrates the anchoring of the panels at one extremity by means of the anchoring members 35, 36, 36*a* and 37. A corresponding anchoring is provided for absorbing pressure loads at the other end of the same panel. Likewise, FIG. 4 shows one end of the special anchoring 29, 30 intended for absorbing upwardly directed forces occurring as tractive forces. The anchor bar 29 is secured correspondingly at its other end.

We claim:

1. A panel for self-supporting roof structures of the type comprising elongated extruded profile elements of plastics material, each said element having at least two side-by-side longitudinal main ducts with external and internal convex outer surfaces and separated by a longitudinal extending secondary duct;

the outer sides of the profile elements having coupling members for securing one profile element side by side to adjacent similar profile elements so as to form a continuous surface requiring only support along two opposite ends;

an intermediate wall in each main duct dividing it into two subducts, said intermediary wall being situated approximately halfway between said external and internal convex outer surfaces; and each secondary duct being divided into at least two subducts by at least one partition wall which lies in general alignment with said intermediary walls in the adjacent main ducts.

2. A panel as claimed in claim 1, in which the secondary duct is divided into four subducts by means of three partition walls, two of which are spaced, respectively, from the nearest end wall of the secondary duct so as to form each of them a subduct of cross-sectional dimensions sufficient to allow the insertion of an anchor bar.

3. A panel as claimed in claim 1, in which the secondary duct is divided into four subducts disposed in series generally perpendicular to the outer walls of the panel; the two outer subducts being shaped to accommodate an anchor bar, while the two intermediate subducts are four-sided in cross-section, having one common side in general alignment with the intermediate wall of the main duct and each having one side parallel with said intermediate wall and in common with the two outer subducts, the two remaining sides making an acute angle with each other.

4. A panel as claimed in claim 3, wherein one of said two remaining sides which makes an acute angle with each other forms approximately a right angle with said intermediate wall.

5. A panel as claimed in claim 3, wherein the profile element comprises three main ducts lying side by side and two intermediate secondary ducts whose side surfaces forming part of the central duct are substantially planar.

6. A panel as claimed in claim 3, in which the ducts are arcuate in the longitudinal direction.

7. A panel as claimed in claim 3, in which the thickness of the intermediate wall of the main ducts and the corresponding wall of the secondary duct is substantially less than the thickness of the other walls of the panel.

8. A self-supporting roof structure composed of panels, each comprising at least two elongated hollow profile elements of thermoplastics material extruded in one piece, each of the hollow profile elements having convex outer surfaces which, together with two generally parallel side walls, form a main duct of substantially rectangular cross-section; said panels being provided along their sides with assembling members in engagement with each other to form a structure interlocked by means of said assembling members cooperating with each other along the outermost side wall of the profile elements;

a first intermediate wall extending in the longitudinal direction within the main duct to divide it into two parallel channels, at least one of said side walls together with a corresponding lateral wall of an adjacent profile element forming a secondary duct;

at least one intermediate wall within said secondary duct and generally in alignment with said first intermediary wall, dividing said secondary duct into subducts of substantially rectangular cross-section.

9. A self-supporting roof structure as claimed in claim 8, wherein the panels are arcuate in their longitudinal direction and are at each extremity secured to a support by means of a bar passing through openings in the lateral walls of the panels, and which is secured to its support by means of an adjustable anchoring member.

10. A self-supporting roof structure as claimed in claim 8, wherein at least one of said subducts is dimensioned so as to accommodate an anchor bar which at its ends is secured to a support.

11. A self-supporting roof structure as claimed in claim 8, wherein the secondary ducts are divided into four subducts by three partition walls generally parallel to the outer surfaces of the panels.

12. A self-supporting roof structure as claimed in claim 8, wherein the secondary ducts are divided into four subducts, of which the two outer ones are dimensioned to accommodate an anchor bar, while each of the two intermediate subducts have three sides approximately at right angles to each other when viewed in cross-section, and the fourth side forms a small angle with the opposite side so that the side common to the two intermediate subducts is longer than the opposite side.

* * * * *